US005589053A

United States Patent [19]

Moran et al.

[11] Patent Number: 5,589,053

[45] Date of Patent: Dec. 31, 1996

[54] ELECTROLYSIS PROCESS FOR REMOVAL OF CAUSTIC IN HEMICELLULOSE CAUSTIC

[75] Inventors: Stephen W. Moran; John R. Jackson, both of Wilmington; Timothy J. Gallivan, Hampstead, all of N.C.; Richard E. Loftfield, Fruitcove, Fla.

[73] Assignee: Huron Tech Incorporated, Kingston

[21] Appl. No.: 553,019

[22] Filed: Nov. 3, 1995

[51] Int. Cl.[6] ..... C02F 1/461

[52] U.S. Cl. ..... 205/698; 205/510; 205/511; 205/517; 205/523; 205/524; 205/688; 205/746

[58] Field of Search ..... 205/687, 688, 205/698, 703, 743, 746, 747, 748, 749, 762, 770, 771, 508, 510, 511, 512, 513, 517, 520, 521, 523, 524, 697; 204/520, 522, 523, 527, 528, 529, 530, 540, 541, 543

[56] References Cited

U.S. PATENT DOCUMENTS

| | | | |
|---|---|---|---|
| 2,905,604 | 9/1959 | Kennedy et al. | 205/688 |
| 3,806,403 | 4/1974 | Ferguson | 162/16 |
| 4,341,609 | 7/1982 | Eskamani et al. | 205/689 |
| 4,584,076 | 4/1986 | Edel et al. | 205/413 |
| 5,034,094 | 7/1991 | Kurple | 162/16 |
| 5,061,343 | 10/1991 | Azarniouch et al. | 162/16 |
| 5,370,771 | 12/1994 | Nilsson | 162/30.1 |
| 5,374,333 | 12/1994 | Nykanen et al. | 162/31 |

*Primary Examiner*—John Niebling
*Assistant Examiner*—John S. Starsiak, Jr.
*Attorney, Agent, or Firm*—Andrew E. Pierce

[57] ABSTRACT

Pulping chemicals and hemicellulose are recovered from a starting solution essentially free of lignin but containing a mixture of hemicellulose and caustic by electrolyzing this solution in the anolyte compartment of an electrolytic cell. By electrolysis, the concentration of caustic in the anolyte is decreased and the concentration of caustic in a catholyte of said cell is increased so as to allow recovery, of about 60 to about 80 percent of the caustic contained in the hemicellulose caustic starting solution.

10 Claims, No Drawings

ELECTROLYSIS PROCESS FOR REMOVAL OF CAUSTIC IN HEMICELLULOSE CAUSTIC

BACKGROUND OF THE INVENTION

1. Field of the Invention

This invention relates to the recovery of caustic from a lignin free solution of hemicellulose and caustic by electrolysis.

2. Description of Related Prior Art

In the production of high purity cellulose fiber used to manufacture rayon, cellulose based films. etc., pulp processed by conventional kraft pulping processes and bleached using chlorine, chlorate, and hydrogen peroxide, the pulp is highly delignified and very clean. The bleaching process steps are very aggressive since low fiber strength and low lignin content so as to obtain high brightness is essential. By the time the pulp enters the last bleaching stages, the lignin content of the pulp is very low. During the last bleaching stages, the hemicellulose and other wood sugars are removed utilizing caustic extraction. Fresh caustic is fed to these stages at a concentration of about 30 to about 35 percent by weight. In a final washing stage, clean water is used to wash away the hemicellulose from the pulp. The water dilutes the caustic solution of hemicellulose to provide a dilute solution off hemicellulose and caustic having a concentration of about 1 to about 10 percent, preferably, about 6 percent by weight caustic. The dissolved hemicellulose gives this solution a brown color. In the paper mill, some of the hemicellulose caustic solution is evaporated to 35 percent caustic content by weight and recycled for use in other parts of the paper mill where the hemicellulose content of the caustic solution is not detrimental such as the initial pulp bleaching and extraction stages in the process.

Because the recovery system for recovering pulping chemicals often represents the critical production limitation in the kraft pulping process because of the limited capacity inherent in the high capital cost for such a recovery system, the capacity of the paper mill to process the entire hemicellulose caustic solution often is inadequate and, accordingly, other methods of recovering a caustic solution, preferably, free of hemicellulose, are needed.

In U.S. Pat. No. 5,061,343, a process is disclosed for the recovery of sodium hydroxide and other values from spent liquors and bleach plant effluents in a kraft pulping mill. This patent discloses a process for removing lignin from an aqueous alkaline liquid by a combination of electrolytic acidification of this liquid and chemical acidification.

U.S. Pat. No. 4.584,076 is cited in the above patent as disclosing a method of treating sulfur-free spent liquors in an electrolysis cell to recover lignin and sodium hydroxide.

It is considered that these references are not directly relevant prior art to the inventive process disclosed herein for the electrolytic recovery of sodium hydroxide and other values such as hemicellulose, oxygen and hydrogen utilizing an electrolytic cell to concentrate an aqueous solution of hemicellulose caustic so as to allow recycling of the sodium hydroxide contained therein.

SUMMARY OF THE INVENTION

In accordance with the invention, a process is disclosed for recovering a purified, concentrated caustic solution from a dilute, essentially lignin free, solution of hemicellulose and caustic obtained as a paper mill discharge stream. A novel electrolytic cell of the filter press type constructed of polyvinyl chloride sheets, preferably, utilizing a bipolar electrode configuration has been found particularly effective for use in the process of the invention. The anode and cathode of the cell can be separated by a any suitable cation exchange membrane cell separator and the preferred bipolar electrode is bonded to individual anode and cathode current collectors utilizing a ductile polyester resin based on a elastomer modified vinyl ester having an elastomeric monomer grafted onto the vinyl ester polymer backbone. The anode and cathode can be any stainless steel or mild steel. Preferably, a 316 stainless steel mesh or a platinum-iridium coating on a ruthenium-titanium mesh substrate is used with a 316 stainless steel wire mesh cathode. Both anode and cathode are separated by stand-off posts in electrical contact with individual current collectors which are in turn bonded with the above described ductile polyester resin which is made electrically conductive by the incorporation of a suitable amount of graphite powder. The electrolytic cell frames of polyvinyl chloride are also bonded with a ductile polyester resin as described above.

By the process of the invention, a dilute, essentially lignin free solution of hemicellulose and caustic is led to the anolyte of an electrolytic cell which is operated at a temperature of about 20° C. to about 100° C. Deionized water is fed to the catholyte compartment of the cell. By the process of the invention, a caustic solution can be withdrawn from the catholyte of said cell at a concentration of up to about 490 grams per liter, preferably, about 150 to about 180 grams per liter while the concentration of caustic in the anolyte of said cell is reduced to about 10 to about 20 grams per liter without precipitation of hemicellulose. Upon withdrawing the hemicellulose solution from the electrolytic cell subsequent to electrolysis, the hemicellulose is precipitated and can be filtered for further use or incineration.

DESCRIPTION OF THE PREFERRED EMBODIMENTS

In accordance with the invention, an aqueous, essentially lignin free solution of hemicellulose and caustic can be concentrated by electrolysis in an electrolytic cell so as to allow removal of hemicellulose from a major amount of the caustic. The caustic can be further concentrated by evaporation so as to permit recycling of the caustic solution to the hemicellulose extraction stage of a pulp mill in a process to make very short, low strength, high purity cellulose fiber used to manufacture rayon, cellulose films, etc.

Both solid and liquid recovery are the critical production limitations at a kraft mill. Methods to reduce the load on the recovery boiler of the pulp mill have been described in U.S. Pat. No. 5,034,094; U.S. Pat. No. 5,374,333; U.S. Pat. No. 5,370,771; and U.S. Pat. No. 5,061,343. These prior art references relate mainly to methods of treatment and recovery of values from pulp mill black liquor which is removed from the process stream for processing. Where a pulp mill process has the object of producing very short, low strength, high purity cellulose fiber for use in the manufacture of rayon, cellulose films etc., the pulp has not only to be highly delignified but in addition, the pulp has to be free of hemicellulose and other wood sugars. These are removed from the pulp by a final purification extraction step utilizing a fresh caustic solution fed to the extraction step of the process at a concentration of about 30 to about 35 percent. Subsequently, a final pulp aqueous washing step is used to wash away the hemicellulose and caustic leaving the desired high purity cellulose fiber. These steps of the pulp mill purification process produce a mixture of hemicellulose and caustic of about 1 to about 10 percent caustic by weight, preferably, as a 6 percent by weight caustic solution. This solution is brown in color as a result of the dissolved hemicellulose. While most of the hemicellulose and caustic solution is normally evaporated to a 35 percent by weight concentration in triple effect evaporators and reused in other parts of the pulp mill where the hemicellulose content is not detrimental to the process such as in the initial bleach and extraction stages, a portion of this 6 percent hemicellulose caustic solution is withdrawn from the process stream and neutralized before disposal to the environment. A portion of this 6 percent hemicellulose and caustic solution can not be reused in the pulp process necessitating the expense involved in the neutralization and the added expense and environmental damage which result by discharge of this solution into a treatment lagoon as an undesirable alternative to the process of the invention.

It is an object of the process of the invention to electrolyze a hemicellulose and caustic solution to achieve a concentration of about 1 to 5 percent by weight caustic in the hemicellulose solution recovered from the anolyte compartment of the electrolysis cell after conducting electrolysis. This solution may be filtered or centrifuged to remove the hemicellulose leaving a solution containing only about 10 to about 30 percent by weight of the original caustic content.

Alternatively, the 6 percent hemicellulose and caustic solution can be concentrated to a caustic content of about 25 percent by weight, by conducting the electrolysis again so as to retain only 1 to 3 percent by weight caustic in the hemicellulose solution after electrolysis. In this alternative process, approximately 90 to about 95 percent by weight of the caustic present in the incoming hemicellulose caustic solution would be recovered.

A third alternative to the treatment of the 6 percent hemicellulose caustic solution would be to concentrate this solution to a concentration of 25 percent by weight and subject this solution to a turbulent flow electrodialysis cell as disclosed in U.S. Pat. No. 5,334,300 so as to remove about half of the caustic present in the incoming hemicellulose and caustic solution and, subsequently, remove approximately the second half of the caustic from the incoming hemicellulose caustic solutions by electrolysis as indicated above.

The electrolytic cell utilized in this process is, preferably, a filter press type electrolysis cell which is constructed utilizing polyvinyl chloride sheets bonded with a ductile elastomer modified vinyl ester polymer characterized by the presence of an elastomeric monomer bonded to the backbone of the polymer. Prior to assembly, the polyvinyl chloride electrolytic cell frames are provided with anolyte and catholyte feed channels and the bonding areas are subjected to sandblasting or other methods of mechanically or chemically abrading or etching the surface so as to improve the strength of the bond.

Where both the anode and cathode are mild steel or any stainless steel, preferably, 316 stainless steel, the cell has a unique bipolar electrode configuration in which a single current collector is attached to the anode and the cathode of the cell. Where the anode and cathode are of dissimilar metals, a bipolar electrode is formed by adhering anode and cathode current collectors with the same elastomer modified vinyl ester polymer made electrically conductive by the addition of a suitable amount of powdered graphite or a powdered metal, such as copper, gold, or silver.

The cell separator is any suitable ion exchange permselective cation-exchange membrane. Examples of cation-exchange membranes are those formed from organic resins, for instance, urea formaldehyde resins or resins obtained by polymerization of styrene and/or divinylbenzene, fluorocarbon resins, polysulfones, polymethacrylic or phenoxy resins or vinyl chloride polymers. Such resins can also be employed as mixed polymers or copolymers. Generally, resins with sulphonic groups are preferred, and among these polyfluorocarbon resins which contain cation-exchange groups are useful. Preferably, a vinyl chloride polymer based cation-exchange membrane sold under the tradename Ionics CR65 is used.

In the following Examples there are illustrated the various aspects of the invention but these Examples are not intended to limit the scope of the invention. Where not otherwise specified in this specification and claims, temperature is in degrees centigrade and percentage is by weight.

EXAMPLE 1

In this Example a 6 percent by weight caustic solution of hemicellulose and caustic was electrolyzed in an electrolytic cell so as to obtain an anolyte volume reduction from electrolysis of 16 percent. This is obtained by a combination of water loss through oxygen evolution and water movement with cations through the cation-exchange permselective membrane cell separator. Total caustic recovery obtained by withdrawal from the catholyte compartment of the electrolytic cell was 76 percent. The electrolyzed hemicellulose caustic solution removed from the anolyte compartment did not precipitate during electrolysis cell operation at 55° to 60° C.

The electrolysis cell was a single bipolar electrolysis cell having a polyvinyl chloride filter press type frame glued after sandblasting the areas to be bonded with an elastomer modified vinyl ester polymer having an elastomeric monomer grafted onto the backbone of the polymer. The cell frames are bonded together to form an electrolysis cell having an active area measuring 46.5 inches high and 4 inches wide. The cell separator used was a vinyl chloride polymer based cation-exchange permselective cell membrane having cation-exchanging radicals. The anode used in the cell was a platinum and iridium coating on a ruthenium and titanium mesh substrate. The anode was spot-welded to a titanium substrate current collector on stand-off posts. The cathode used was 316 stainless steel wire mesh spot-welded to a 316 stainless steel substrate on stand-off posts connected to a cathode current collector. Bipolar contact between the anode and cathode current collectors was made by utilizing an electrically conductive cement which is a mixture of powdered graphite and a vinyl ester polymer having an elastomeric monomer grafted onto the vinyl ester polymer backbone to provide a more ductile and flexible polyester. Graphite powder having a particle size of about 10 microns was present in the proportion of about 40 percent by weight of the mixture. The electrode to separator gaps for both anode and cathode were 0.040 inches to 0.060 inches. The cell was operated under the following test conditions: 1.07 amps per square inch; total cell amperage was 193 amps. A head pressure of 12 inches was maintained on the anode side of the cell. The anode feed rate was 123 milliliters per minute. The anode overflow rate for the spent hemicellulose solution was 103 milliliters per minute. The anode feed was 63 grams per liter of sodium hydroxide and 16 to 18 grams per liter equilibrium concentration in the anode compartment. The cathode feed was deionized water which was fed at a rate of about 16 milliliters per minute. The cathode overflow was about 36 milliliters per minute. A sodium hydroxide equilibrium concentration in the cathode compartment of 160 to 170 grams per liter was obtained. Electrolyte recirculation in both compartments of the cell was obtained by gas lift only. The cell was operated at a temperature of 55° to 60° C. by providing cooling utilizing a cooling coil in a cathode gas disengager tank. The temperature differential across the separator was about 5° C.

EXAMPLE 2

In a second experiment utilizing the above cell the cell anolyte was electrolyzed to obtain a concentration of 10 grams per liter of sodium hydroxide with no hemicellulose precipitate being formed in the cell while operating at a cell temperature of 55° to 60° C. When the anolyte solution was removed from the cell, allowed to stand, and cool, a white precipitate formed. This precipitate settles to occupy a volume of about 66 percent of the original volume of the solution upon standing overnight.

While this invention has been described with reference to certain specific embodiments, it will be recognized by those skilled in the art that many variations are possible without departing from the scope and spirit of the invention, and it will be understood that it is intended to cover all changes and modifications of the invention disclosed herein for the purpose of illustration which do not constitute departures from the spirit and scope of the invention.

What is claimed is:

1. A process for recovering pulping chemicals and hemicellulose from an essentially lignin free starting solution comprising hemicellulose and caustic said process comprising:

A) electrolyzing in an anolyte compartment of an electrolytic cell a hemicellulose starting solution containing about 2 to about 20 percent by weight of caustic to reduce the caustic content of said anolyte to about 10 to about 20 grams per liter without precipitation of said hemicellulose to obtain a caustic content in a catholyte compartment of said cell of about 60 to about 80 percent of the caustic content of said starting solution, said cell comprising an anode in said anolyte compartment and a cathode in said catholyte compartment, and said anode and cathode separated by a cationic permselective membrane cell separator and B) removing a caustic solution from the catholyte of said cell having a concentration of up to about 490 grams per liter.

2. The process of claim 1 wherein said hemicellulose and caustic starting solution contains about 6 percent by weight of caustic.

3. The process of claim 2 wherein said aqueous caustic solution removed from said cell has a concentration by weight of about 12 to about 18 percent.

4. The process of claim 3 wherein said electrolytic cell is operated at a temperature of about 20° C. to about 100° C.

5. The process of claim 4 wherein oxygen is produced at the anode and hydrogen is produced at the cathode of said cell.

6. The process of claim 5 wherein said cationic permselective membrane cell separator is a vinyl polymer based cation exchange membrane separator.

7. The process of claim 6 wherein hemicellulose is recovered from said anolyte compartment by precipitation of said hemicellulose and filtering.

8. The process of claim 7 wherein said anode and cathode of said electrolytic cell are individually selected from any mild steel or stainless steel.

9. The process of claim 8 wherein said electrolytic cell is a bipolar electrode electrolytic cell wherein said anode and cathode are in electrical contact with individual current collectors bonded with an electrically conductive ductile polyester resin.

10. The process of claim 9 wherein said ductile polyester resin is an elastomer modified vinyl ester polymer having an elastomeric polymer grafted onto the backbone of said vinyl ester polymer.

* * * * *